US006887423B2

(12) United States Patent
Van Trump et al.

(10) Patent No.: US 6,887,423 B2
(45) Date of Patent: May 3, 2005

(54) PROCESS FOR MAKING A STRETCHABLE NONWOVEN WEB

(75) Inventors: James Edmond Van Trump, Wilmington, DE (US); Vishal Bansal, Richmond, VA (US); Michael C. Davis, Midlothian, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 302 days.

(21) Appl. No.: 10/253,292

(22) Filed: Sep. 24, 2002

(65) Prior Publication Data

US 2003/0064650 A1 Apr. 3, 2003

Related U.S. Application Data

(60) Provisional application No. 60/324,855, filed on Sep. 26, 2001.

(51) Int. Cl.[7] ..... D01D 5/088; D01D 5/16; D01D 5/22; D01D 5/32; D01D 5/34

(52) U.S. Cl. ..... 264/555; 264/103; 264/168; 264/172.14; 264/172.15; 264/210.8; 264/211.14

(58) Field of Search ..... 264/103, 168, 264/172.14, 172.15, 210.8, 211.14, 555

(56) References Cited

U.S. PATENT DOCUMENTS

| | | | | |
|---|---|---|---|---|
| 3,671,379 A | | 6/1972 | Evans et al. | |
| 4,115,989 A | | 9/1978 | Spolnicki | |
| 4,118,534 A | | 10/1978 | Stanley | |
| 4,977,611 A | | 12/1990 | Maru | |
| 4,997,611 A | * | 3/1991 | Hartmann | 264/210.8 |
| 5,102,724 A | | 4/1992 | Okawahara et al. | |
| 5,382,400 A | | 1/1995 | Pike et al. | |
| 5,750,151 A | | 5/1998 | Brignola et al. | |
| 6,454,989 B1 | * | 9/2002 | Neely et al. | 264/555 |

FOREIGN PATENT DOCUMENTS

| | | |
|---|---|---|
| EP | 0 586 924 A | 3/1994 |
| FR | 1 579 662 A | 8/1969 |
| FR | 2 167 678 A | 8/1973 |
| WO | WO 00/66821 A1 | 11/2000 |

* cited by examiner

*Primary Examiner*—Leo B. Tentoni

(57) ABSTRACT

A process for preparing nonwoven webs including multiple component continuous filaments having high levels of three-dimensional helical crimp utilizing draw rolls to provide a high degree of orientation to each of the polymeric components by mechanically drawing the filaments under conditions wherein the polymeric components remain substantially amorphous and a stretchable nonwoven web including multiple component, continuous filaments having high levels of three-dimensional helical crimp.

10 Claims, 2 Drawing Sheets

PROCESS FOR MAKING A STRETCHABLE NONWOVEN WEB

This application claims benefit of priority from Provisional Application No. 60/324,855 filed on Sep. 26, 2001.

BACKGROUND OF THE INVENTION

1. Field of the Invention

This invention relates to stretchable multiple component spunbond webs and a process for preparing spunbond webs comprising filaments having high levels of crimp.

2. Description of Related Art

Nonwoven webs made from multiple component filaments are known in the art. For example, U.S. Pat. No. 5,102,724 to Okawahara et al. (Okawahara) describes a two-way stretch nonwoven fabric comprising bicomponent polyester filaments produced by conjugate spinning of side-by-side filaments of polyethylene terephthalate copolymerized with a structural unit having a metal sulfonate group and a polyethylene terephthalate or a polybutylene terephthalate.

U.S. Pat. No. 5,382,400 to Pike et al. (Pike) describes a process for making a nonwoven fabric which includes melt-spinning continuous multiple component polymeric filaments and crimping the continuous multiple component filaments for forming into a nonwoven fabric.

International Publication No. WO 00/66821 to Hancock-Cooke et al. (Hancock) describes stretchable nonwoven webs that comprise a plurality of bicomponent filaments that have been point-bonded prior to heating to develop crimp in the filaments.

U.S. Pat. No. 3,671,379 to Evans et al. (Evans) describes self-crimpable composite filaments that comprise a laterally eccentric assembly of at least two synthetic polyesters.

U.S. Pat. No. 5,750,151 to Brignola, et al. (Brignola) describes a spunbond process which includes a pair of draw rolls enclosed in a shroud. The draw rolls provide the tension required to draw the filaments near the spinneret face.

U.S. Pat. No. 4,977,611 to Maru (Maru) describes the production of spunbonded fabrics which optionally include draw rolls for imparting mechanical draw to the filaments.

While stretchable nonwoven fabrics made from multiple component filaments are known in the art, there exists a need for a method for producing uniform stretchable nonwoven fabrics from multiple component filaments which have high retractive power and which do not require a separate mechanical crimping step in order to achieve high levels of stretchability.

BRIEF SUMMARY OF THE INVENTION

This invention is directed to a method for forming a stretchable nonwoven web comprising the steps of:

melt spinning a plurality of continuous filaments comprising at least first and second distinct melt-spinnable polymers, the polymers being arranged in distinct substantially constantly positioned zones across the cross-section of the filaments in an eccentric relationship and extending substantially continuously along the length of the filaments;

quenching the filaments in a quench zone using a gas;

passing the filaments in a single wrap alternately under and over at least two serpentine feed rolls, the feed rolls being rotated at a surface speed such that the first and second polymers remain substantially amorphous in the quench zone, passing the filaments in a single wrap alternately under and over at least two serpentine draw rolls, the draw rolls being rotated at a surface speed that is greater than the surface speed of the feed rolls so that the filaments are drawn between the feed rolls and the draw rolls, the temperature of the draw rolls being sufficient to form partly-crystalline filaments of the first and second polymeric components, passing the partly-crystalline filaments into a gas forwarding jet, the jet imparting tension to the filaments between the draw rolls and the jet, passing the drawn and partly-crystalline filaments out of the gas forwarding jet thereby releasing the tension on the filaments and causing the filaments to form helical crimp, depositing the filaments onto a moving support surface located below the forwarding jet to form a nonwoven web of helically crimped filaments.

The invention is also directed to a stretchable nonwoven fabric comprising helically crimped multiple component spunbond continuous filaments, said filaments comprising poly(ethylene terephthalate) and poly(trimethylene terephthalate) in a side-by-side or eccentric sheath-core arrangement.

DETAILED DESCRIPTION OF THE INVENTION

Figure 1:
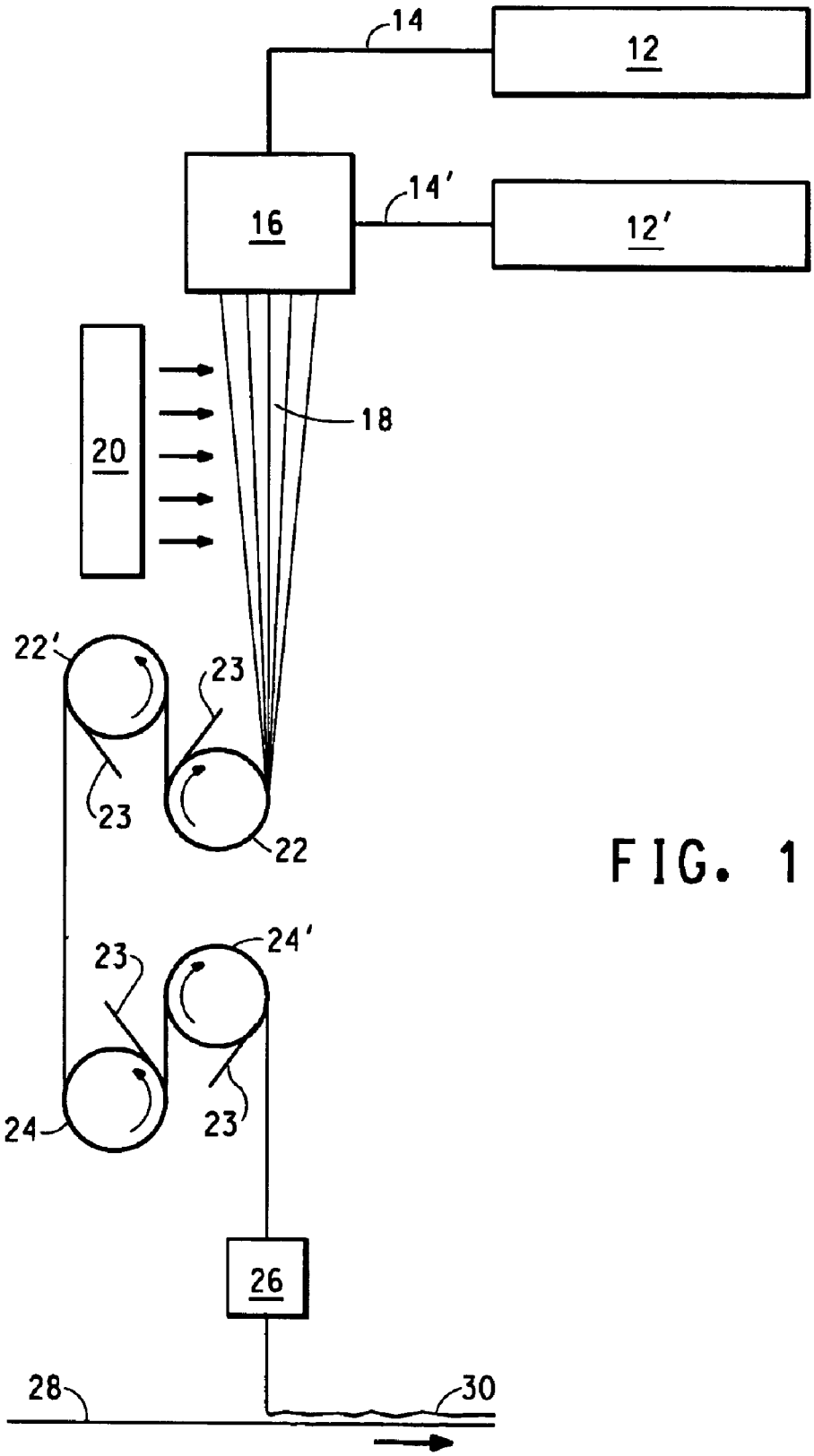
FIG. 1 is a schematic diagram of a side view of a spunbond process according to the invention for preparing a bicomponent spunbond fabric.

The present invention is directed toward a method for forming continuous helically crimped multiple component spunbond filaments and stretchable nonwoven webs made from such filaments.

The term "polyester" as used herein is intended to embrace polymers wherein at least 85% of the recurring units are condensation products of dicarboxylic acids and dihydroxy alcohols with linkages created by formation of ester units. This includes aromatic, aliphatic, saturated, and unsaturated di-acids and di-alcohols. The term "polyester" as used herein also includes copolymers (such as block, graft, random and alternating copolymers), blends, and modifications thereof. A common example of a polyester is poly(ethylene terephthalate) (PET) which is a condensation product of ethylene glycol and terephthalic acid.

The terms "nonwoven fabric" or "nonwoven web" as used herein mean a structure of individual fibers, filaments, or threads that are positioned in a random manner to form a planar material without an identifiable pattern, as opposed to a knitted or woven fabric.

The term "multiple component filament" as used herein refers to any filament that is composed of at least two distinct polymers which have been spun together to form a single filament. By the term "distinct polymers" it is meant that each of the at least two polymers are arranged in distinct substantially constantly positioned zones across the cross-section of the multiple component filaments and extend substantially continuously along the length of the filaments. Multiple component filaments are distinguished from filaments that are extruded from a homogeneous melt blend of polymeric materials in which zones of distinct polymers are not formed. Multiple component and bicomponent filaments useful in the current invention have laterally eccentric cross-sections, that is, the polymeric components are arranged in an eccentric relationship in the cross-section of the filament. Preferably, the multiple component filament is a bicomponent filament which is made of two distinct polymers having an eccentric sheath-core or a side-by-side arrangement of the polymers. Most preferably, the multiple component filament is a side-by-side bicomponent filament. If the bicomponent filament has an eccentric sheath-core configuration, preferably, the lower melting polymer is in the sheath to facilitate thermal bonding of the final nonwoven fabric. The term "multiple component web" as used herein refers to a nonwoven web comprising multiple component filaments. The term "bicomponent web" as used herein refers to a nonwoven web comprising bicomponent filaments.

The term "spunbond" filaments as used herein means filaments which are formed by extruding molten thermoplastic polymer material as filaments from a plurality of fine, usually circular, capillaries of a spinneret with the diameter of the extruded filaments then being rapidly reduced by drawing. Other filament cross-sectional shapes such as oval, multi-lobal, etc. can also be used. Spunbond filaments are generally continuous and have an average diameter of greater than about 5 micrometers. Spunbond nonwoven fabrics or webs are formed by laying spunbond filaments randomly on a collecting surface such as a foraminous screen or belt. Spunbond webs are generally bonded by methods known in the art such as hot-roll calendering or passing the web through a saturated-steam chamber at an elevated pressure. For example, the web can be thermally point bonded at a plurality of thermal bond points located across the spunbond fabric.

As used herein, the term "serpentine rolls" means a series of two or more rolls which are arranged with respect to each other such that the filaments are directed under and over sequential rolls with a single wrap on each roll and in which alternating rolls are rotating in opposite directions.

FIG. 1 illustrates a schematic of a side view of a process line according to the current invention for preparing a stretchable bicomponent web. The process is intended to encompass preparing multiple component spunbond webs as well. The process line includes two extruders 12 and 12' for separately extruding a first polymer component and a second polymer component. The polymeric components are preferably selected according to the teaching in Evans, which is hereby incorporated by reference. In Evans, the polymeric components are partly crystalline polyesters, the first of which has chemical repeat-units in its crystalline region that are in a non-extended stable conformation that does not exceed 90 percent of the length of the conformation of its fully extended chemical repeat units (hereafter referred to at times as non-extended polymer). The second polymeric component has chemical repeat-units in its crystalline region which are in a conformation more closely approaching the length of the conformation of its fully extended chemical repeat-units than the first polyester (hereafter referred to at times as extended polymer). The term "partly crystalline" as used in defining the filaments of Evans serves to eliminate from the scope of the invention the limiting situation of complete crystallinity where the potential for shrinkage would disappear. The amount of crystallinity, defined by the term "partly crystalline" has a minimum level of only the presence of some crystallinity (i.e. that which is first detectable by X-ray diffraction means) and a maximum level of any amount short of complete crystallinity. Examples of suitable fully extended polyesters are poly(ethylene terephthalate), poly (cyclohexyl 1,4-dimethylene terephthalate), copolymers thereof, and copolymers of ethylene terephthalate and the sodium salt of ethylene sulfoisophthalate. Examples of suitable non-extended polyesters are poly(trimethylene terephthalate), poly (tetramethylene terephthalate), poly(propylene dinaphthalate), poly(propylene bibenzoate), and copolymers of the above with ethylene sodium sulfoisophthalate, and selected polyester ethers. When ethylene sodium sulfoisophthalate copolymers are used, it is preferably the minor component, i.e. present in amounts of less than 5 mole percent and preferably present in amounts of about 2 mole percent. In an especially preferred embodiment, the two polyesters are poly(ethylene terephthalate) and poly (trimethylene terephthalate). Hereafter, the aforementioned bicomponent may at times be referred to as poly(ethylene terephthalate)/poly(trimethylene terephthalate or as 2GT/3GT. The bicomponent filaments of Evans have a high degree of helical crimp, generally acting as springs, having a recoil action whenever a stretching force is applied and released. Other partly crystalline polymers that are suitable for use in the current invention include syndiotactic polypropylene, which crystallizes in an extended conformation, and isotactic polypropylene, which crystallizes in a non-extended, helical conformation.

The first and second polymer components, for example poly(trimethylene terephthalate) and poly(ethylene terephthalate) are fed as shown in FIG. 1 as molten streams from the extruders 12 and 12' through respective lines 14 and 14' to a spin beam 16 where they are extruded through a spinneret comprising bicomponent extrusion orifices (not shown). It should be noted that there is no requirement that one particular polymer is the first and another is the second. Spinnerets for use in spunbond processes are known in the art and generally have extrusion orifices arranged in one or more rows along the length of the spinneret. The spin beam generally includes a spin pack (not shown) that distributes and meters the polymer. Within the spin pack, the first and second polymer components flow through a pattern of openings arranged to form the desired filament cross-section. The polymers are spun from the extrusion orifices of the spinneret to form a plurality of vertically oriented filaments, which creates a curtain of downwardly moving filaments. In the embodiment shown in FIG. 1, the curtain is formed from three rows of filaments 18 extruded from three rows of bicomponent extrusion orifices. The spinneret can be a pre-coalescent spinneret where the different molten polymer streams are brought together prior to exiting the extrusion orifice and extruded as a layered polymer stream through the same extrusion orifice to form a multiple component or bicomponent filament. Alternately, a post-coalescent spinneret can be used where the different molten polymer streams are contacted with each other after exiting the extrusion orifices to form a multiple component or bicomponent filament. In a post-coalescent process, the different polymeric components are extruded as separate polymeric strands from groups of separate extrusion orifices which join with other strands extruded from the same group of extrusion orifices to form a single multiple component or bicomponent filament.

The spinneret orifices and spin pack design are chosen so as to provide filaments having the desired cross-section and denier per filament. The ratio of the two polymeric components in each filament is generally between about 10:90 to 90:10 based on volume (for example, measured as a ratio of metering pump speeds), preferably between about 30:70 to 70:30, and most preferably between about 40:60 to 60:40. When the multiple component filaments are bicomponent filaments comprising poly(trimethylene terephthalate) and poly(ethylene terephthalate), the volume ratio of poly (trimethylene terephthalate) to poly(ethylene terephthalate) is preferably about 40:60 to 60:40. After exiting the spinneret, the filaments pass through a quench zone. The extrusion orifices in alternating rows in the spinneret can be staggered with respect to each other in order to avoid "shadowing" in the quench zone, where a filament in one row effectively blocks a filament in an adjacent row from the quench air. The filaments are preferably quenched using a cross-flow gas quench supplied by blower 20. Generally, the quench gas is air provided at ambient temperature (approximately 25° C.) but can also be either refrigerated or heated to temperatures between about 0° C. and 150° C. Alternately, quench gas can be provided from blowers placed on opposite sides (not shown) of the curtain of filaments. This would provide a co-current gas flow wherein the gas is directed in substantially the same travel direction as the filaments.

It is sometimes desirable, particularly when maximum crimp development is desired, that the high-shrinkage component be more highly oriented. This can be achieved using the process shown in FIG. 1 when side-by-side bicomponent fibers are produced where quench air is provided from one side of the curtain of filaments, by configuring the spinning apparatus such that the quench air is directed towards the side of the filaments comprising the nonextended-type (high shrinkage) polymer component to increase the degree of orientation in the high-shrinkage component relative to the degree of orientation of the extended-type polymer when exiting the quench zone. Alternately, the orientation in the high shrinkage polymer can be increased by increasing the molecular weight, and hence the melt viscosity, of the high-shrinkage polymer. Preferred molecular weights for poly(ethylene terephthalate) is 40,500 at an intrinsic viscosity of 0.55 dl/g and for poly(trimethylene terephthalate) is 43000 at an intrinsic viscosity of 0.9 dl/g. When a bicomponent filament is formed by spinning two polymers having significantly different viscosities as a layered mass through a single spin orifice, the filament has a tendency to bend up towards the spinneret face immediately after exiting the spin orifice. In some cases, the filament can contact the spinneret face and adhere to the spinneret surface. This can be especially a problem when, in order to maximize the crimp in the final fibers, polymers such as poly(ethylene terephthalate)/poly(trimethylene terephthalate are arranged in a side-by-side relation in the bicomponent fiber, wherein the viscosity of the poly(trimethylene terephthalate) can be as much as an order of magnitude greater than that of the poly(ethylene terephthalate). To overcome this problem, filaments can be spun using a post-coalescent spinneret. It has been found that bicomponent fibers spun from poly (ethylene terephthalate) having an intrinsic viscosity of about 0.36–0.6 dl/g (corresponding number average molecular weight of 24,600–44,700) and poly(trimethylene terephthalate) having an intrinsic viscosity of about 0.9–1.5 dl/g (corresponding number average molecular weight of 43,000–87,000) using a post-coalescent spinneret have high levels of crimp. This is desirable for forming stretchable spunbond nonwoven fabrics of the current invention.

The length of the quench zone is selected so that the filaments are cooled to a temperature such that no further drawing occurs as they exit the quench zone and such that the filaments do not stick to each other. It is not generally required that the filaments be completely solidified at the exit of the quench zone.

The filaments are drawn in the quench zone due to the tension provided by feed rolls 22 and 22' under conditions so that the polymers in the bicomponent filaments do not crystallize to any substantial degree. Generally, this requires that the drawing in the quench zone be done at relatively low speeds, preferably between about 300 and 3000 meters/minute (measured as the surface speeds of feed rolls 22 and 22' in FIG. 1). For 2GT/3GT it has been found that spinning speeds in the quench zone of 800–1200 meters/minute are preferred. In conventional spunbond processes, spinning speeds of 1000–6000 meters/minute can be generally achieved. This results in rapid drawing of the filaments at high temperatures in the quench zone. Since the crystallization rate of the polymers is a function of the polymer orientation (crystallization rate can increase by up to 4–5 orders of magnitude as a function of orientation), and in conventional spunbond processes the filaments are being drawn at high speeds while still at relatively high temperature, polymers such as poly(ethylene terephthalate) generally crystallize rapidly in the quench zone at the high spinning speeds. As the filaments exit the quench zone, the filaments are generally not crimped and if removed from the process at this point would not develop significant crimp upon heat treatment.

A pneumatic quench can also be used, wherein a co-current flow is used but the quench gas is also accelerated in the same travel direction of the filaments as they pass through the quench zone. This can provide some increased amount of draw to the filaments and permits higher spin speeds than for cross-flow quench, and consequently higher machine efficiency, without providing increased polymer spin orientation. This is accomplished because the forwarding gas stream changes the tension profile of the spinning threadline, forcing more extension to occur near the spinneret, where the higher temperature permits the polymer to relax fast enough to preclude significant orientation.

After exiting the quench zone, a spin finish, such as a finish oil, can optionally be applied to the filaments, for example by contacting the filaments with a licker roll which is coated with finish and which is running at a slower speed than the filaments. Also, if a nonwoven fabric having antistatic properties is desired, an antistatic finish can be applied to the filaments. When spin finishes are used, generally more than two rolls per set of serpentine rolls will be required because the finish oil reduces the friction between the rolls and filaments. This lower friction increases the likelihood of slippage of the filaments on the rolls and can result in a reduction in throughput and a failure to segment the tension between the quench, draw, and laydown zones. This could effectively lower the mechanical draw, thereby reducing the crimp that is achieved in the final fibers. This is especially an issue in the process of the current invention, where single wraps of filaments on the rolls are used, instead of multiple wraps that would typically be used in a conventional melt spinning process. A higher number of rolls also increases the possibility of roll wraps. For purposes of economy, the process of the current invention is preferably conducted with no spin finish ("finish-free") and using two rolls in each set of serpentine rolls.

Figure 2A:
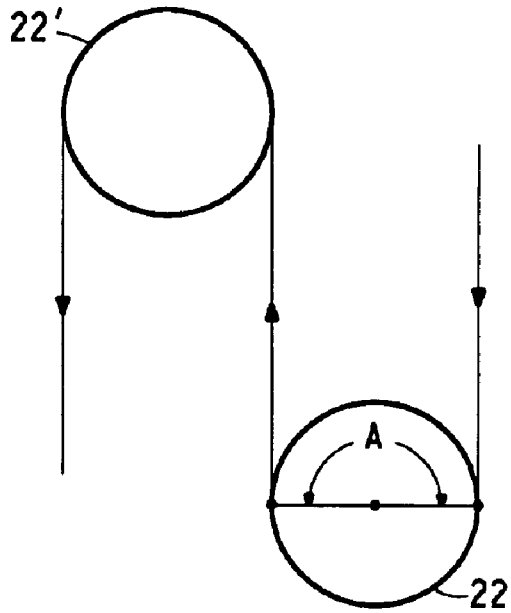
FIGS. 2A and 2B are schematic diagrams showing a side view of two different configurations of serpentine draw rolls useful in the current invention.
Figure 2B:
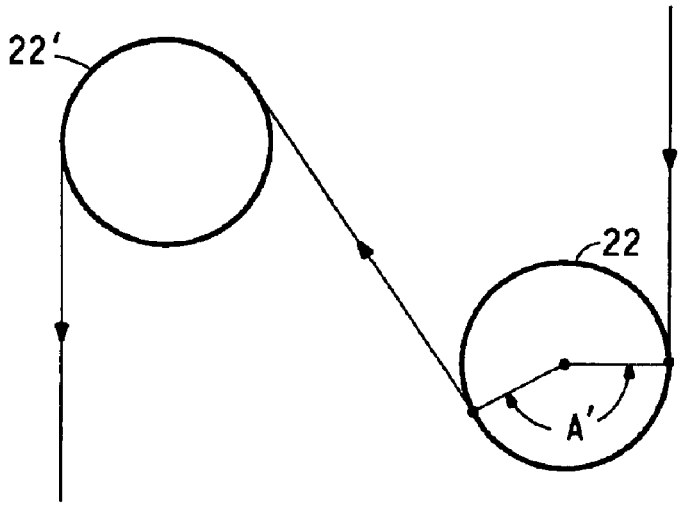

Preferably, after the quench zone, the curtain of vertically oriented quenched bicomponent filaments is passed sequentially under and over two sets of driven serpentine rolls with a single filament wrap on each roll as shown in FIG. 1. The first set of serpentine rolls 22 and 22' is referred to as the feed rolls and the second set of serpentine rolls 24 and 24' is referred to as the draw rolls. Each set of serpentine rolls comprises at least two rolls. In the embodiment shown in FIG. 1, two sets of serpentine rolls, each set consisting of two rolls, are used. However, it should be understood that more than two rolls per set of serpentine rolls can be used. Preferably, the rolls are positioned to provide the greatest contact between the filaments and the roll. In FIGS. 2A and 2B, two different serpentine roll configurations are shown and wrap angle A is the angle at the center of the roll measured between the point where the filaments first contact the roll and the point at which they exit the roll. In FIG. 2A, the wrap angle A is intended to be about 180 degrees. In FIG. 2B, the wrap angle A' is intended to be less than 180 degrees. Wrap angles of about 180 degrees and higher are preferred because increased contact and friction is provided between the filaments and the rolls, resulting in less slippage. Contact angles up to about 270 degrees can generally be used.

The feed rolls, 22 and 22', are rotated at approximately equal speeds but in opposite directions as indicated by the arrows, and are heated to a temperature that stabilizes the location of the draw point. Preferably, the draw point is stabilized at a point on feed roll 22' very close (within about one inch, for example) of the point where the filaments exit feed roll 22'. The feed rolls are preferably maintained at a temperature between about room temperature (about 25° C.) and about 110° C. If the feed roll temperature is too high, the filaments can stick to each other, forming nodes, broken filaments or undrawn segments. If the feed roll temperature is too low, a stable draw point is difficult to obtain. In a spunbond process for 2GT/3GT bicomponent fibers, the feed rolls are preferably heated at temperatures between about 60° C. and 80° C. Alternately, the filaments may be heated between the two sets of serpentine rolls, such as by using a steam jet (100° C.) or other heating means, such that the filaments are drawn at a localized point between the two sets of rolls.

The drawn filaments are then passed under and over the second set of rolls, which are heated serpentine draw rolls 24 and 24' both rotating in opposite directions at approximately equal speeds. The surface speeds of the draw rolls 24 and 24' are generally greater than the surface speeds of feed rolls 22 and 22' so as to provide the tension required to draw the filaments. Second draw roll 24' can be run at a slightly higher speed than first draw roll 24. As the filaments are drawn, further orientation is developed in both of the polymeric components of the bicomponent filaments. Because the drawing is done at temperatures at which substantially no relaxation takes place, it is believed that the orientation developed as a result of the drawing process is substantially equal for each of the polymeric segments. The speed of the draw rolls is set such that the filaments are mechanically drawn at a draw ratio between the feed and draw rolls from about 1.4 to 1 to about 5 to 1. Preferably, the draw ratio is in the range of about 3.5 to 1 to about 4 to 1. The maximum operating speed as defined by the surface speed of the draw rolls can reach up to about 5200 meters/minute, or about 7000 meters/minute if a pneumatic quench is used. At speeds greater than these, excessive filament breaks can occur. For 2GT/3GT bicomponent spunbond filaments, the surface speed of the draw rolls is about 3200 m/minute and the surface speed of the feed rolls is about 800 m/minute. Without being held to any theory, it is believed that when heated feed rolls are used, the filaments are drawn at a point close to where the filaments leave feed roll 22' where the filaments are the hottest and tension from the second set of rolls is first applied, so that the drawing is complete before the filaments contact draw roll 24. The filaments preferably have a denier per filament after drawing in the range of about 2 to 5, however an effective process with filaments having a denier per filament in the range of about 1 to 20 may be possible without significant process modifications. The drawing conditions are selected so that the polymeric components in the filaments remain substantially amorphous during the drawing step.

Draw rolls 24 and 24' are heated to anneal the filaments after drawing. During annealing, the filaments are heated to a temperature at which each of the polymeric components crystallize and become partly crystalline. This results in an increase in the differential shrinkage between the different components. If the filaments were removed from the process immediately following annealing, they would form three-dimensional helical crimp when in a relaxed state. In order to stabilize the crystallinity, the annealing temperature is preferably higher than any temperature that the yarn will encounter in further processing or testing so that the helical crimp will not be lost during such further processing or testing. For bicomponent or multiple component filaments comprising poly(ethylene terephthalate) and poly (trimethylene terephthalate), the draw rolls preferably have a temperature of between about 120° C. and 185° C., more preferably between about 150° C. and about 165° C. It is important to anneal the filaments under modest tension (at least about 0.3 g/denier) in order to prevent relaxation before crystallization occurs, thus maximizing the degree of crimp in the final spunbond filaments.

Feed rolls 22 and 22' and draw rolls 24 and 24' can be equipped with filament "strippers" 23 that extend for substantially the axial length of the driven rolls and lightly contact the rolls immediately downstream of the filament take-off points for each roll. The filament strippers 23 are generally located tangent to the rolls, but the appropriate angle and mounting needed to use the filament strippers are easily determined by one skilled in the art for a given machine and set of process circumstances. The filament strippers 23 can be made from any reasonably stiff card or film stock which does not have a tendency to melt on the surface of the feed or draw rolls. KAPTON® film and NOMEX® paper, both available from E. I. du Pont de Nemours and Company (Wilmington, Del.), have been found to be suitable for use in the present invention. The strippers help to prevent roll wraps caused by broken filaments by stripping off the boundary layer of air adjacent to each roll surface and causing the broken filament to be thrown in the air and to fall onto the web and proceed through the process rather than forming a roll wrap.

After annealing, the filaments are passed through a forwarding or throw-down jet 26 that just provides sufficient tension to prevent the filaments from slipping on the draw rolls. After exiting the forwarding jet, the tension on the filaments is released and the filaments crimp in a three-dimensional helix.

Forwarding jet 26 is typically an aspirating jet which, in addition to maintaining tension on the draw rolls, can provide a stream of gas, such as an air jet, to entrain the filaments and expel them onto moving foraminous belt 28 located below the jet to form a nonwoven web 30. Standard attenuating jets, for example a slot jet, used in conventional spunbond processes can be used as the forwarding jet. Such aspirating jets are well known in the art and generally include an elongate vertical passage through which the filaments are drawn by aspirating air entering from the sides of the passage and flowing downwardly through the passage. In conventional processes, the aspirating jet provides the draw tension to provide spin draw in the filaments. In the process described in Pike, the forwarding jet is a heated forwarding jet which, in addition to providing draw tension, is heated to a temperature sufficient to activate the latent crimp in the multiple component filaments. In the process of the current invention, most of the draw is introduced as mechanical draw between feed rolls 22 and 22' and draw rolls 24 and 24' and (as noted above) the forwarding jet 26 serves primarily to forward the filaments onto foraminous belt 28 located below the jet. A suction box or vacuum source (not shown) can be provided under the belt 28 to remove the air from the forwarding jet and to pin the filaments to the belt once they are deposited thereon. The helical filaments are deposited on the belt to form a nonwoven web of helically crimped filaments.

After depositing the filaments as a multiple component spunbond web comprising continuous helically crimped filaments onto belt 28, the web is generally bonded in-line to form a bonded spunbond fabric which is then generally wound up on a roll. Optionally, the web can be lightly compressed by a compression roller prior to bonding. Bonding can be accomplished by thermal bonding in which the web is heated to a temperature at which the low melting component softens or melts causing the filaments to adhere or fuse to each other. For example, the web can be thermally point bonded at discrete bond points across the fabric surface to form a cohesive nonwoven fabric. In a preferred embodiment, thermal point bonding or ultrasonic bonding is used. Typically, thermal point bonding involves applying heat and-pressure at discrete spots on the fabric surface, for example by passing the nonwoven layer through a nip formed by a heated patterned calender roll and a smooth roll. During thermal point bonding, the low melting polymeric component is partially melted in discrete areas corresponding to raised protuberances on the heated patterned roll to form fusion bonds which hold the nonwoven layers of the composite together to form a cohesive bonded nonwoven fabric.

The pattern of the bonding roll may be any of those known in the art, and are preferably discrete point bonds. The bonding can be in continuous or discontinuous patterns, uniform or random points or a combination thereof. Preferably, the point bonds are spaced at about 2–40 per inch (0.8–16/cm) and more preferably, about 2–10 per inch (0.8–4/cm). The bond points can be round, square, rectangular, triangular or other geometric shapes, and the percent bonded area is at least about 3% and preferably between about 3% and about 70%. The percent bonded area is more preferably between about 3% and about 20% and most preferably between about 3% and about 10%.

The nonwoven web can also be bonded using through air bonding wherein heated gas, generally air, is passed through the web. The gas is heated to a temperature sufficient to soften or melt the low-melting component to bond the filaments at their cross-over points. Through-air bonders generally include a perforated roller, which receives the web, and a hood surrounding the perforated roller. The heated gas is directed from the hood, through the web, and into the perforated roller. When 2GT/3GT bicomponent filaments are used, the web is preferably heated to temperatures between about 200 to 250° C. during thermal bonding. Generally, fabrics that have been through air bonded have higher loft than those prepared using thermal point bonding. Bonding can also be accomplished by needle-punching or hydroentangling. The bonded nonwoven fabric has a high degree of stretch due to the high levels of helical crimp in the multiple component filaments. The stretchable nonwoven fabric can then be wound onto a winding roller and would be ready for further treatment or use. Preferably, the fabric is wound up at low tension and the winding roller has tension control.

Nonwoven fabrics prepared according to the process of the current invention from 2GT/3GT bicomponent filaments are useful in a number of end uses including apparel such as tops and bottoms (pants skirts, etc.), intimate apparel, outerwear, absorbents, hygiene products (e.g., sanitary facings and diaper components), medical/industrial apparel/drapes, wipes, home furnishings, etc.

What is claimed is:

1. A method for forming a stretchable nonwoven web comprising the steps of:

melt spinning a plurality of continuous filaments comprising at least first and second distinct melt-spinnable polymers, the polymers being arranged in distinct substantially constantly positioned zones across the cross-section of the filaments in an eccentric relationship and extending substantially continuously along the length of the filaments;

quenching the filaments in a quench zone using a gas;

passing the filaments in a single wrap alternately under and over at least two serpentine feed rolls, the feed rolls being rotated at a surface speed such that the first and second polymers remain substantially amorphous in the quench zone, passing the filaments in a single wrap alternately under and over at least two serpentine draw rolls, the draw rolls being rotated at a surface speed that is greater than the surface speed of the feed rolls so that the filaments are drawn between the feed rolls and the draw rolls, the temperature of the draw rolls being sufficient to form partly-crystalline filaments of the first and second polymeric components, passing the partly-crystalline filaments into a gas forwarding jet, the jet imparting tension to the filaments between the draw rolls and the jet, passing the drawn and partly-crystalline filaments out of the gas forwarding jet thereby releasing the tension on the filaments and causing the filaments to form helical crimp, depositing the filaments onto a moving support surface located below the forwarding jet to form a nonwoven web of helically crimped filaments.

2. The method of claim 1, wherein the surface speed of the feed rolls is between 300 and 3000 meters/minute.

3. The method of claim 1, wherein the surface speed of the draw rolls is between 2 and 5 times greater than the surface speed of the feed rolls.

4. The method of claim 1, wherein the temperature of the feed rolls is between about 25° C. and about 110° C.

5. The method of claim 1, wherein the first polymer is an extended polymer and the second polymer is a non-extended polymer.

6. The method of claim 5, wherein the first polymer is syndiotactic polypropylene and the second polymer is isotactic polypropylene.

7. The method of claim 5, wherein the first polymer is an extended polymer selected from the group consisting of poly(ethylene terephthalate), poly(cyclohexyl 1,4-dimethylene terephthalate), copolymers thereof, and copolymers of ethylene terephthalate and the sodium salt of ethylene sulfoisophthalate and the second polymer is a non-extended polymer selected from the group consisting of poly(trimethylene terephthalate), poly(tetramethylene terephthalate), poly(propylene dinaphthalate), poly (propylene bibenzoate), copolymers thereof with ethylene sodium sulfoisophthalate, and polyester ethers.

8. The method of claim 6, wherein the first polymer is poly(ethylene terephthalate) and the second polymer is poly(trimethylene terephthalate).

9. The method of claim 6, wherein the temperature of the draw rolls is between about 120° C. and about 185° C.

10. The method of claim 6, wherein during the quenching step the quenching gas is directed toward side of the filaments comprising the non-extended polymer component.

* * * * *